United States Patent [19]

Werthmann

[11] 4,213,819

[45] Jul. 22, 1980

[54] METHOD OF PRODUCING LARGE-FORMAT EMBOSSING TOOLS

[75] Inventor: Wilfried Werthmann, Krefeld, Fed. Rep. of Germany

[73] Assignee: Firma Standex International GmbH, Krefeld, Fed. Rep. of Germany

[21] Appl. No.: 878,432

[22] Filed: Feb. 16, 1978

[30] Foreign Application Priority Data

Feb. 18, 1977 [DE] Fed. Rep. of Germany ..... 2706947

[51] Int. Cl.[2] ..... C23F 1/02

[52] U.S. Cl. ..... 156/660; 156/235; 156/661.1; 156/905

[58] Field of Search ..... 156/232, 654, 659, 660, 156/658, 661, 905, 235; 101/32, 28; 96/36, 36.3, 38.1, 37

[56] References Cited

U.S. PATENT DOCUMENTS

| | | | |
|---|---|---|---|
| 2,854,336 | 9/1958 | Guttknecht | 156/661 X |
| 3,726,732 | 10/1973 | Richardson et al. | 156/345 X |

FOREIGN PATENT DOCUMENTS

| | | | |
|---|---|---|---|
| 310389 | 4/1929 | United Kingdom | 156/660 |

*Primary Examiner*—William A. Powell
*Attorney, Agent, or Firm*—Karl F. Ross

[57] ABSTRACT

Large format embossing tools for applying a given contour to synthetic-resin plates, sheets or foils, e.g., to produce a leather-like or wood-like pattern therein, are produced by printing onto the plates the predetermined pattern in an etch-resist and then repeating the process with a different pattern so that portions of the tool, e.g., an embossing plate for multideck presses, are etched more and less deeply.

3 Claims, 4 Drawing Figures

METHOD OF PRODUCING LARGE-FORMAT EMBOSSING TOOLS

FIELD OF THE INVENTION

The present invention relates to a method of producing tools for imparting a pattern to synthetic-resin material, e.g., plastic plates, sheets or foils and, more particularly, to a method of producing such etching tools in a reproducible manner free from junctions between portions of a pattern.

BACKGROUND OF THE INVENTION

In the plastics or synthetic-resin arts, it is a common practice to apply a contoured pattern to a surface of a synthetic-resin plate, sheet or foil using an embossing tool having the complementary contour or pattern.

The pattern-forming operation may result from a molding of the pattern against the tool or by pressing the tool into the preformed plate or web of sheet or foil material.

The tool, which can be a metal drum or plate, can thus form part of an embossing press, e.g., a multideck or multilevel press, or can form part of a mold in which the synthetic-resin material is shaped.

The application of an embossing pattern to synthetic-resin materials has been used to emboss relatively soft synthetic-resin sheets which can be used in the upholstery, luggage, show or garment industries. In this case, the synthetic-resin sheet has an embossed pattern which may correspond to the pattern of natural leather, textile fabrics and the like. In this case, the synthetic-resin sheet or foil, generally as a continuous web, is passed between an embossing roll and a counterpressure roll, the embossing roll having a metal surface in which the complementary pattern is formed.

Plastic plates used in the furniture industry can have a grid-like rough wood-imitation pattern, and are usually formed by molding in presses having press plates constituting the tool and provided with a surface texture or contour complementary to that to be reproduced in the product.

In all cases, it is important that the molding tools produce an uniform pattern on the plastic plates or sheets without join marks, steps or lines between portions of the pattern.

This is necessary to ensure that the imitation of the natural product, such as wood or leather, will be as authentic as possible. In addition, it is essential that one be able readily to produce a multiplicity of embossing tools which are absolutely identical so that worn tools can be replaced. Large numbers of identical tools are also required when multideck presses are to be used with a plurality of such tools in the mass production of large numbers of embossed identical articles.

Thus, in this field, it is important to be able to produce high-quality, identically-patterned metal embossing tools in an inexpensive manner.

To produce embossing patterns on embossing tools for the aforedescribed purpose, several methods are known. Direct engraving by hand using conventional engraving tools and even machine engraving is impractical because the process is usually extremely time-consuming and does not permit of exact reproduction of the desired pattern.

Thus, the preparation of such tools has required reliance upon etching techniques. In the etching approach, an etch resist is applied to the metallic surface of a plate or roll to constitute the tool and areas not covered by the resist are subjected to treatment with an etching solution and chemical removal by solubilization of the metal.

There are two main techniques for generating an etch-resist pattern upon the metal surface. In the reproduction photography approach, the resist is a photosensitive material which is exposed through a photographic negative. The unfixed portions of the resist are washed away while the fixed portions remain so that etching occurs in the regions in which the resist has been removed. The other approach applies the resist in a predetermined pattern by screen printing.

Some problems have been encountered heretofore in the production of embossing or molding plates by reproduction photography, for example, at the present time photographic films have a maximum width of 160 cm, for all practical purposes, so that, to form a plate with dimensions of 230×600 cm., at least two negatives must be placed upon the substrate coated with the photosensitive resist. Where the negatives adjoin, a step or interruption is formed in the pattern to be reproduced, thereby requiring a difficult, time-consuming machining process or retouching process for removal of the join line. Frequently such attempts are unsatisfactory or incomplete. This disadvantage is most pronounced when fine-grain textures are to be produced since, in this case, the film is formed with a multitude of minute dots.

In the screen-printing technique, wherein the etching resist is applied by means of a rotary screen directly to the surface of the metal plate or sheet, problems are also encountered. The pattern on the rotary screen is often produced by a photographic process so that the difficulties previously described may result here as well. Furthermore, the screen is generally a perforated metal sheet or wire mesh of cylindrical configuration through which a relatively viscous substance, namely, the etching resist, is pressed by a doctor plate onto the metal plate. Because of the viscosity of this material, it does not penetrate fine meshes having 100 or more openings per cm. with sufficient uniformity to allow the reproduction by the etched metal plate of fine-grain textures.

Another characteristic of all prior-art etching techniques for the preparation of embossing plates is that the depths of the etching is the same in all areas while the unetched regions or lands remain completely smooth. Natural-looking imitations of wood grain, with the multilevel texture extending generally across the entire width of the surface, cannot be achieved with techniques which provide a constant depth of etching and perfectly smooth lands over the entire textured surface. Other fine-grain surfaces such as those involved in the production of imitation leather also cannot be produced by embossing plates with smooth-land characteristics. In the latter case, the fine details required for a true imitation of natural products cannot be reproduced in the etching resist or upon the embossing plate because the viscosity of the resist does not normally allow fine and close detail to be readily duplicated. In other words, with screen printing using viscous resist, the resist can cover relatively larger areas of the metal surface than is desirable and as a result the smooth surfaces of lands remaining beneath the resist has a relatively large area, unsatisfactory for fine detailing.

OBJECTS OF THE INVENTION

It is the principal object of the present invention to provide an improved method of producing embossing or molding plates for the purposes described, whereby the disadvantages of the earlier systems discussed above are overcome.

Another object of the invention is to provide an improved method of embossing synthetic resin materials such as sheets, plates and film with patterns having close or fine-grain textures more readily able to serve as imitations of natural leather or wood.

SUMMARY OF THE INVENTION

These objects and others which will become apparent hereinafter are attained, in accordance with the present invention, by a method which comprises printing by transfer of a patterned layer of etching resist upon the metal plate to form an etching-resist pattern thereon, etching the plate through this layer of resist, removing the resist after the initial etching operation, printing the previously etched surfaces of the plate with a second patterned layer of the resist by transfer from a surface, and etching through the second patterned layer to a depth equal to, less than or greater than the initial etching depth, and removing the second resist layer from the plate.

In other words, an essential feature of the invention is the application of the resist to the plate with etching therethrough, two or more times so that the etching operation is repeated. Another important feature of the invention is that the patterned layer of the etching resist for each of the repeated etching operations is applied by transfer from a surface onto which the resist layer has been previously applied. Preferably the transfer surface is a roller or drum. Other details thereof will be provided below.

The method of the present invention has the advantage of producing significantly more varied textures by providing several levels of depth. Each subsequent etching operation will effect lands or areas which have remained unetched from a prior operation or a number of prior etching operations and in addition can increase the depth of previous etches so as to impart a new and finer texture to the embossing surface of the plate.

It is particularly desirable to treat areas that were covered by the resist in earlier etching steps so as to impart a fine grained rough surface, a fine wood tick or other texture thereto. It has been found to be possible using this technique, to imitate natural wood textures with the finest of tick detail.

It has been found to be advantageous, according to a feature of the invention, to produce the resist pattern by using the same copy film in a number of etching operations with superimposition of the pattern in a random manner and without registration or repeat. Such superimposition has been found to eliminate steps or join marks unintentionally left by the retoucher. The same or different embossing patterns may be used for the repeated application of the resist carriers.

While, in principle, such engraved embossing tools may be embossing rolls to which the etch resist is applied by flat screens, rotary screen or copy-film techniques, so that the rolls can be used for embossing plastic metal sheets or foils, etc. the invention preferably makes use of a transfer surface to which the resist has previously been applied, e.g., by any of the means described, from which the resist is applied to the metal substrate adapted to be etched.

The invention has been found to be particularly applicable to the production of press plates and especially press plates for use in multilevel or deck presses in which a number of plastic sheets or sheets of other materials are embossed in a stacked relationship with a corresponding number of embossed plates, the pressure being applied to the stack.

Here again, the resist can be applied to the press plate by flat or rotary screens or copy-film techniques. However, it is most advantageous and a particular feature of the invention that, for large format press plates whose width can exceed the maximum width of the copy film, the resist is transferred from an engraved or etched master or print roll to a transfer roll which applied the patterned resist to the surface of the plate. This transfer roll may be formed with a transfer surface consisting of a silicone-rubber which may be coated onto a metal drum or formed as a sleeve which is slipped over the metal drum.

The latter process is thus similar to off-set printing and is, of course, reprinted one or more times. It has the advantage that it produces a completely uniform pattern without join marks on the etched plate. Both for the master or print roll and for rotary screens, the width of existing film material is sufficient to cover the entire surface of the roll without having to piece two or more together. Any join mark of the copy film, after being wrapped around the roll is easily excessible and readily treated by the retoucher who, tests have shown, is able to work more effectively on the rolls than on a large plate.

An important advantage of the invention is that the master roll or rotary screen, which applies the patterned resist to the transfer roll, can be used for the production of a larger number of identically engraved press plates. Thus, if a customer reorders a particular type of embossing plate, it can be reproduced faithfully if the master roll or rotary screen is stored for this eventuality.

The muster or print roll is provided with the etch resist by a carrier roll and a doctor plate installation which fill the indentations on the master roll forming the pattern, the silicone-rubber surface of the transfer roll then picking up the resist from these indentations in the master roll.

In the transfer of resist to form superimposed patterns on a plate already etched to one level or depth in a previous etching process, the resist can be pressed by the resilient silicone-rubber layer into the depth provided in this earlier etching step so that, by a particularly simple process, fine and coarse textures may be combined in repeat and/or at random.

It is also possible, in accordance with the present invention, to initially etch a fine texture or grain in a press plate and subsequently etch a grid, textile or other coarse pattern therein. In this case, the fine grain texture is stronger in areas which are covered with the resist in the subsequent stage although exposed to the etchant will either lose the fine grain texture entirely or retain this texture in a somewhat faded and to a less defined degree.

BRIEF DESCRIPTION OF THE DRAWING

The above and other objects, features and advantages of the present invention will become more readily apparent from the following description reference being made to the accompanying drawing in which.

SPECIFIC DESCRIPTION AND EXAMPLES

The following examples represent the modes in which the present invention can be used, it being understood that the best mode will be that described with reference to FIG. 1.

Figure 1:
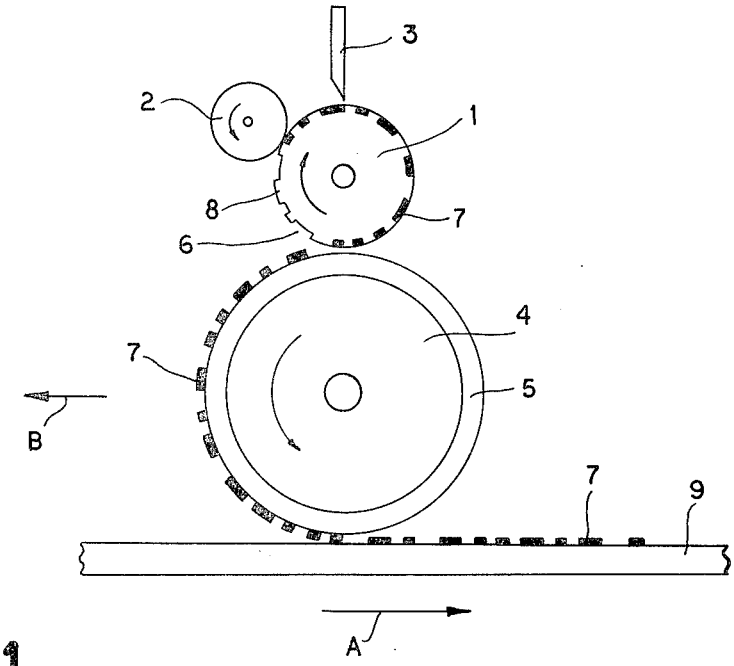
FIG. 1 is a diagrammatical side-elevational view of an apparatus for producing large-format embossing plates in accordance with the present invention.

Large-format engraved press plates which are used to manufacture textured laminates in multi-deck or multi-level presses, are produced by using the device shown schematically in FIG. 1. This device comprises a master roll 1 which is formed with indentations into which the resist can be doctored by a blade 3, the resist being applied to the roll 1 by a carrier roll 2.

The master roll 1 rolls along the silicone-rubber sleeve 5 of a transfer roller or drum 4 which takes up the patterned resist 7 and applies it to the press plate 9 to be etched. All of the rolls have an axial length equal to the full width of the press plate 9. According to the embossing pattern desired two or more copies of fine or coarse or partial-detail patterns are made which are then applied to respective master rolls or rotary screens by, for example, the method described above. While rotary screens can be used only for horizontal application to the transfer rolls and the plates, master rolls provided with indentations into which the resist is doctored, can also be used for vertically transported press plates. The latter mode of application has been found to be advantageous since patterned layers of the resist can be applied to both sides of the press plates simultaneously and the press plate can thus have two embossed surfaces for the embossing of two laminates in the multilevel press.

Preferably, however, the master rolls are produced by photoengraving. This has been found to give master rolls with coarse, fine or partial patterns corresponding to the final texture in a highly effective and clean manner. However, only a single etching operation is used in the preparation of each master roll.

According to the invention, two or more master rolls are thus produced with different patterns which, using the device of FIG. 1, are transferred successively in resist patterns to the workpiece, i.e., the plate 9. Between applications of the resist, and after each application of the resist, etching is carried out and the previously applied layer of resist is removed. Multi-level textures are thus generated as will be seen more readily from FIGS. 2A–2C. Prior to use, the master roll may be chromium plated or hardened.

The different master rolls 1 are then mounted in the device of FIG. 1 for the successive resist-application operations. By means of the carrier roll 2 and the doctor plate 3, the indentations of the master roll 1 are filled with the resist 7 while the raised area or land of the master roll remain free of the resists. The master roll 1 rolls the patterned layer of the resist onto the silicone-rubber sleeve 5 which trasfers the resist to the surface of the plate 9 in the pattern desired. The press plate 9 may be carried under the transfer roll 4 in the direction of arrow A or the entire device may be displaced in the direction of arrow B along the press plate 9 which can then be held stationary after each application of the resist, the press plate 9 is etched in the usual manner, whereupon the etched plate is treated with a resist again using the same or other master rolls with a random or registered pattern.

If the press plate is to produce an authentic wood grain, the first operation will reproduce the overall coarse design while a second operation will apply a pattern representing the pores of natural wood. In a third operation gradations in depth are achieved, corresponding, for example, to the annual rings formed by natural wood growth. If desired, the resist can be applied only in selected areas of the press plate and, for this purpose the silicone-rubber sleeve may be recessed or cut out according to the pattern. This approach can be used to transfer resist only to areas previously etched or only to areas left unetched in previous operations.

The process also permits the production of multilevel embossing plates with patterns according to artistic and graphic designs such as multi-level coffer effects, pictorial reproductions and the like. It has been found to be advantageous to use the process for the production of plastic laminates with a microfine rough texture. To achieve this result the master roll can be engraved with indentations of a minute dot shape and may be used to apply the resist several times with random orientation of the roll with respect to the plate. The result is a uniform fine texture not unlike that obtained by sandblasting with the difference that sandblasting surfaces of corresponding dimensions do not show the same degree of regularity of the grain.

Figure 2A:
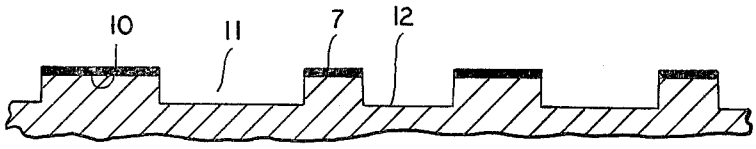
FIGS. 2A–2C are diagrammatic cross-sectional views, drawn to a greatly enlarged scale and illustrating the effects of three successive etching steps in accordance with the invention.
Figure 2B:
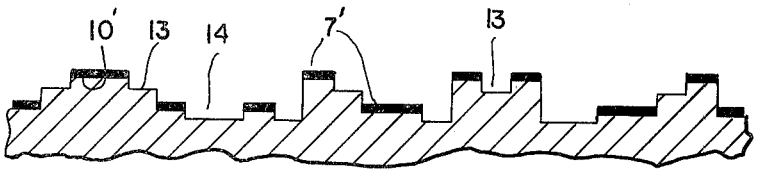
Figure 2C:
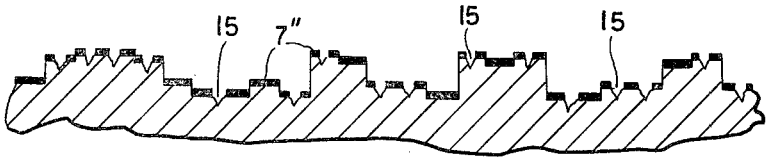

FIGS. 2A–2C show in highly diagrammatic form the surface of the press plate subjected to the repetitive etching and resist-applying operations. In the first step (FIG. 2A), the areas of the original surface 10 which were covered with the resist 7 produce lands separated by indentations 11 formed by etching the region between these lands.

Upon the surface 12 of these indentations 11 and in accordance with a second pattern, and upon the portions 10′ of the original lands, a second layer of resist is applied as represented at 7′. If the etching time is then reduced accordingly, smaller indentations 13 in the original lands 10 or smaller indentations 14 in the surface 12 of the original indentations 11 are generated by the second etching process. In a third operation, the resist 7″ is applied selectively over all of the newly exposed surfaces in accordance with a third pattern so that etching produces dot-like indentations 15. The total engraving thus has five levels as will be apparent from FIG. 2C upon final etching. Generally this level will not appear as steps in the manner shown in FIGS. 2A–2C but will be more or less irregular depending upon the etching duration.

The etching depth can range between 10–100 microns with the application of the coarse pattern being followed by an etching to a depth of 80–100 microns, the intermediate etching being carried out to a depth of 50–80 microns, and the fine etching to a depth of as little as 10 microns.

I claim:

1. A method of making an embossing tool for the embossing of plates, sheets or foils, said method comprising the steps of:

(a) indirectly applying to a metal substrate of a large format press plate for a synthetic resin plate press a first layer of an etching resist in a predetermined pattern by applying a patterned layer of the resist by a patterned roll to a silicone-rubber surface of a transfer roll and then rolling the patterned layer onto said substrate with the silicone-rubber surface of the transfer roll;

(b) etching a surface of said substrate through said layer of resist to effect a first pattern etching of said surface; and (c) repeating steps (a) and (b) in succession at least twice with application of a respective layer of resist to said substrate for each repetition out of total registry with an etch pattern previously produced in said surface of said substrate, the first of the etching operations being carried out to a depth of 80 to 100 microns, a second of the etching operations being carried out to a depth of 50 to 80 microns and a third etching operation being carried out to a lesser depth as low as 10 microns.

2. The method defined in claim 1 wherein the same pattern of resist application is used in subsequent applications to said substrate but out of registry with one another.

3. The method defined in claim 1 wherein the resist pattern applied to said substrate in successive openings applications are different.

* * * * *